US008316596B2

(12) United States Patent
Anderson et al.

(10) Patent No.: US 8,316,596 B2
(45) Date of Patent: Nov. 27, 2012

(54) IG UNIT MEMBRANE VALVE AND PRESSURE MODIFICATION

(75) Inventors: Howard C. Anderson, Tracy, IA (US); Andy Schirz, Leighton, IA (US); Kenneth E. Nossaman, Pella, IA (US)

(73) Assignee: Pella Corporation, Pella, IA (US)

( * ) Notice: Subject to any disclaimer, the term of this patent is extended or adjusted under 35 U.S.C. 154(b) by 454 days.

(21) Appl. No.: 12/559,913

(22) Filed: Sep. 15, 2009

(65) Prior Publication Data

US 2011/0061319 A1 Mar. 17, 2011

(51) Int. Cl.
*E06B 3/00* (2006.01)
*E06B 3/964* (2006.01)

(52) U.S. Cl. ..... 52/204.63; 52/204.62; 52/204.67; 52/204.7; 52/786.1; 52/788.1; 52/204.71

(58) Field of Classification Search ..... 52/204.593, 52/204.595, 204, 597, 210–213, 204.62, 52/204.63, 204.67, 204.68, 204.7, 204.71, 52/786.1, 788.1, 204.597, 204.1
See application file for complete search history.

(56) References Cited

U.S. PATENT DOCUMENTS

| | | | | | |
|---|---|---|---|---|---|
| 2,720,009 | A | * | 10/1955 | Lippman, Jr. | 65/59.22 |
| 2,756,467 | A | | 7/1956 | Etling | |
| 2,784,462 | A | * | 3/1957 | Fix | 156/109 |
| 2,805,452 | A | * | 9/1957 | Englehart | 29/458 |
| 2,887,737 | A | * | 5/1959 | Prescott | 65/43 |
| 2,887,738 | A | * | 5/1959 | Prescott et al. | 65/43 |
| 3,280,523 | A | * | 10/1966 | Stroud et al. | 52/172 |
| 3,852,149 | A | * | 12/1974 | Sitter et al. | 428/34 |
| 4,044,519 | A | | 8/1977 | Morin et al. | |
| 4,057,945 | A | * | 11/1977 | Kessler | 52/204.593 |
| 4,193,236 | A | * | 3/1980 | Mazzoni et al. | 52/172 |
| 4,567,703 | A | * | 2/1986 | Ricks | 52/204.52 |
| 4,587,784 | A | | 5/1986 | Chavy et al. | |
| 4,724,637 | A | * | 2/1988 | Evans | 52/209 |
| 4,984,402 | A | * | 1/1991 | Davies | 52/204.593 |
| 5,270,084 | A | | 12/1993 | Parker | |
| 5,345,734 | A | | 9/1994 | Tremblay | |
| 5,366,574 | A | | 11/1994 | Lenhardt et al. | |
| 5,377,473 | A | | 1/1995 | Narayan et al. | |
| 5,424,509 | A | | 6/1995 | Schaugaard et al. | |
| 5,439,716 | A | | 8/1995 | Larsen | |

(Continued)

FOREIGN PATENT DOCUMENTS

FR 2344700 10/1977

(Continued)

OTHER PUBLICATIONS

Edgetech I.G. Spacer Systems Insulating Glass Manufacturing Manual, pp. 31-34, © 2007 Edgetech I.G., marked rev Mar. 30, 2009.

*Primary Examiner* — Jeanette E. Chapman
(74) *Attorney, Agent, or Firm* — Faegre Baker Daniels, LLP

(57) ABSTRACT

An IG unit includes a perimeter structure having a port, a first pane supported by the perimeter structure, a second pane supported by the perimeter structure opposite the first pane with an interior space defined between the first and second panes that is sealed and connected to the port, and a membrane valve assembly adapted to act as a self-sealing access to the port. The membrane valve assembly optionally includes a first sealant layer, a second membrane layer, and a third sealant layer, for example.

21 Claims, 5 Drawing Sheets

U.S. PATENT DOCUMENTS

| | | | | |
|---|---|---|---|---|
| 5,653,073 | A | 8/1997 | Palmer | |
| 5,674,417 | A | 10/1997 | Schaugaard et al. | |
| 5,679,419 | A | 10/1997 | Larsen | |
| 5,705,010 | A | 1/1998 | Larsen | |
| 5,714,214 | A | 2/1998 | Larsen | |
| 5,855,638 | A | 1/1999 | Demars | |
| 6,055,783 | A | 5/2000 | Guhl et al. | |
| 6,209,269 | B1 | 4/2001 | Valderrama | |
| 6,301,858 | B1 | 10/2001 | Crandell | |
| 6,457,294 | B1 | 10/2002 | Virnelson et al. | |
| 6,463,706 | B1 | 10/2002 | Guhl et al. | |
| 6,506,272 | B1 | 1/2003 | Aggas | |
| 6,553,728 | B1 * | 4/2003 | Zurn | 52/171.3 |
| 6,622,456 | B2 | 9/2003 | Almasy | |
| 6,662,507 | B1 | 12/2003 | Bendy | |
| 6,692,600 | B2 | 2/2004 | Veerasamy et al. | |
| 6,701,681 | B2 | 3/2004 | Kim | |
| 6,804,924 | B2 | 10/2004 | Zurn et al. | |
| 6,889,480 | B2 * | 5/2005 | Guhl et al. | 52/786.1 |
| 6,916,392 | B2 | 7/2005 | Trpkovski et al. | |
| 7,044,443 | B2 | 5/2006 | Nakamura | |
| 7,134,251 | B2 | 11/2006 | Zurn et al. | |
| 7,281,686 | B2 | 10/2007 | Wood | |
| 7,997,037 | B2 * | 8/2011 | Crandell et al. | 52/204.593 |
| 2001/0032436 | A1 * | 10/2001 | Riegelman | 52/786.13 |
| 2005/0132663 | A1 | 6/2005 | Guhl et al. | |
| 2006/0191215 | A1 | 8/2006 | Stark | |
| 2006/0286317 | A1 | 12/2006 | Berkowitz | |
| 2007/0033887 | A1 | 2/2007 | Ambrose | |
| 2007/0199259 | A1 | 8/2007 | Parsley | |

FOREIGN PATENT DOCUMENTS

| | | |
|---|---|---|
| WO | WO 2005/001229 | 1/2005 |
| WO | WO 2005/031102 | 4/2005 |
| WO | WO 2006/121954 | 11/2006 |
| WO | WO 2006/123935 | 11/2006 |
| WO | WO 2008/028099 | 3/2008 |

* cited by examiner

IG UNIT MEMBRANE VALVE AND PRESSURE MODIFICATION

BACKGROUND

An insulating glass ("IG") unit, or "IGU," typically includes a pair of generally parallel panes, or "glazing panels," held in a spaced-apart relationship by one or more spacers. The resulting open space between the panes, the "interior" of the IG unit, is filled with gas (including gas mixtures) such as air, or more insulative gas such as argon or krypton, for example. The insulating gas is typically sealed in the IG unit under ambient conditions, including atmospheric temperatures and/or pressures corresponding to a manufacturing location.

SUMMARY

Some aspects relate to accessing an interior of an IG unit through a self-sealing membrane valve to adjust an internal pressure of the IG unit, to a membrane valve assembly, as well as to an insulated glass (IG) unit that includes a membrane valve assembly. For example, in some embodiments, an IG unit includes a perimeter structure having a port, a first pane supported by the perimeter structure, a second pane supported by the perimeter structure opposite the first pane with an interior space defined between the first and second panes that is sealed and connected to the port, and a membrane valve assembly adapted to act as a self-sealing access to the port. In some embodiments, the membrane valve assembly includes a first sealant layer, a second membrane layer, and a third sealant layer, for example. Still other additional or alternate features are contemplated, including those described in greater detail in the following sections.

Figure 3:
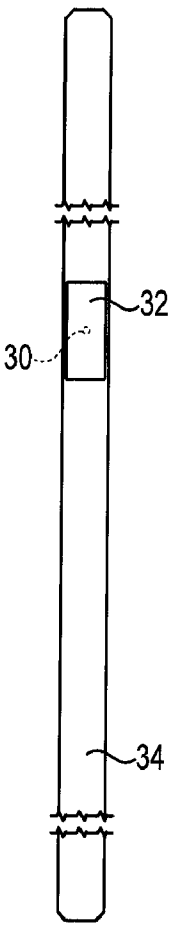
FIG. 3 is an end view of the spacer system and self-sealing membrane valve assembly of the IG unit of FIG. 1.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Some embodiments relate to accessing an interior of an IG unit through a self-sealing membrane valve to adjust an internal pressure of the IG unit. The self-sealing membrane valve optionally utilizes a higher durometer membrane material between thinner, lower durometer layers of sealant to accomplish desired sealing characteristics. In some implementations, the internal pressure of the IG unit is adjusted using the self-sealing membrane valve to pre-calibrate the IG unit to pressure conditions at an installation site (e.g., prior to shipment to the installation site). In other embodiments, the self-sealing membrane valve is utilized at the installation site to post-calibrate the internal pressure of the IG unit to pressure conditions at the installation site (e.g., after or during installation). While some features associated with various embodiments have been provided above, those features are not meant to be limiting in nature and additional and/or alternative features are also contemplated.

Figure 1:
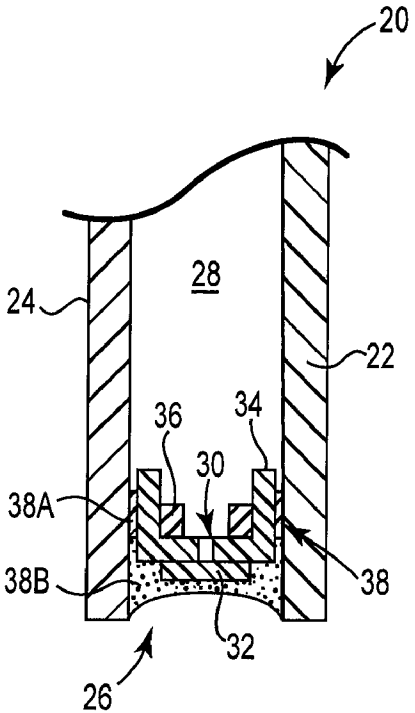
FIG. 1 is a cross-sectional and schematic view of an IG unit, according to some embodiments.

FIG. 1 is a cross-sectional view of an insulated glass (IG) unit 20 shown in schematic form according to some embodiments. With reference to FIG. 1, the IG unit 20 includes a first pane 22, a second pane 24, and a perimeter structure 26 maintaining the first and second panes 22, 24 in a spaced, sealed relationship to define an interior 28 of the IG unit 20. The IG unit 20 also has a port 30 into the interior 28 of the IG unit 20 and a self-sealing membrane valve assembly 32 blocking the port 30. Some embodiments of the IG unit 20 also include an optional muntin bar system (not shown). Although the port 30 is shown in the perimeter structure 26, or a portion thereof, in some other embodiments the port 30 is located elsewhere (e.g., in one of the first and second panes 22, 24). The unit 20 is shown as being substantially rectangular, although a variety of shapes are contemplated, such as round, oval, and triangular, for example. Furthermore, it should be understood that a variety of unit arrangements, such as double hung, casement, awning, bay, fixed frame, skylight, and others, are contemplated.

The first and second panes 22, 24 each define an inner face and an outer face, where the inner faces are generally positioned opposite to and facing toward one another. Each of the first and second panes 22, 24 also defines a thickness and an overall shape characterized by an aspect ratio. As used herein, aspect ratio generally refers to a ratio of a longer dimension of a pane (e.g., height) to a shorter dimension of the pane (e.g., width), or a ratio of a major axis (e.g., height) to a minor axis (e.g., width) of the pane. For example, a pane that is substantially square or substantially circular would be characterized by an aspect ratio close to 1. Other shapes, oval or triangular, for example, are also contemplated.

In some embodiments, the first and second panes 22, 24 are each formed of a substantially transparent sheet material, such as a glass or plastic. Unless specified otherwise, as used herein, the terms "IG" and "insulated glass" are not meant to actually require glass material for the panes 22, 24. "IG units" or "insulated glass units" having plastic panes, for example, are clearly contemplated and intended to fall within the meaning of the terms "IG units" and "insulated glass units," such meaning also being in accord with common industry usage. The first and second panes 22, 24, respectively, define various physical properties, or material properties, including a modulus of elasticity (E), percent elongation at fracture (% L), and ultimate tensile strength (UTS), for example, among others.

In some embodiments, the perimeter structure 26 includes a spacer system 34, a desiccant system 36, and a boundary system 38. In some embodiments, the optional muntin bar system (not shown) additionally or alternatively includes the desiccant system 36 (e.g., the desiccant system 36 or a portion thereof is optionally disposed within the structure of the muntin bar system). Also, in some embodiments, the perimeter structure 26 includes a window sash or frame.

The spacer system 34 is optionally formed as a framework of discrete components or as a single, monolithic unit as desired. The spacer system 34 is optionally of a substantially consistent profile, although a plurality of discrete spacers and/or spacer sections with differing profiles and configurations are also contemplated.

Figure 2:
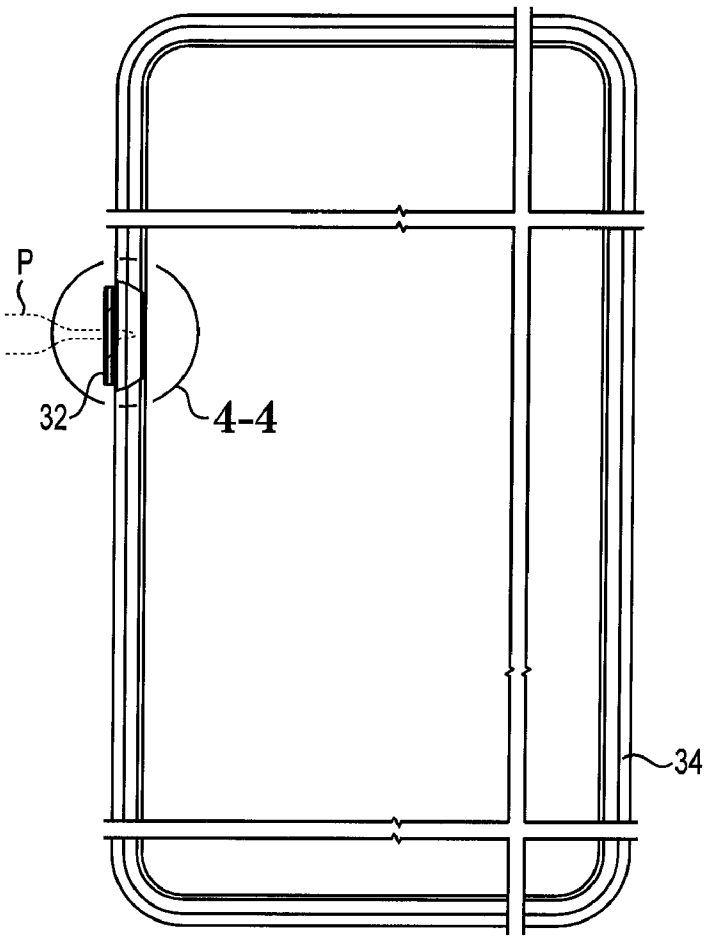
FIG. 2 is a front view of a spacer system and self-sealing membrane valve assembly of the IG unit of FIG. 1.

FIG. 2 is a front view of the spacer system 34 and the self-sealing membrane valve assembly 32 and FIG. 3 is an end view of the spacer system and self-sealing membrane valve assembly 32. The spacer system 34 is generally elongate, extending along a periphery of the first and second panes 22, 24 (FIG. 1) along the edges and/or between the inner faces thereof. The spacer system 34 is optionally formed of metal, such as aluminum or stainless steel, thermo-set or thermoplastic materials, including foam materials, such as a silicone foam material, ceramics, or other materials and combinations thereof. In some embodiments, the spacer system 34 is a flowable material that is deposited on the pane(s) 22, 24, for example, and subsequently hardens and/or cures.

Some examples of acceptable spacer systems are described in U.S. Pat. No. 5,377,473 (entitled "Insulating Glass Unit with Insulative Spacer" and issued Jan. 3, 1995), U.S. Pat. No. 5,439,716 (entitled "Multiple Pane Insulating Glass Unit with Insulative Spacer" and issued Aug. 8, 1995), U.S. Pat. No. 5,679,419 (entitled "Multiple Pane Insulating Glass Unit with Insulating Spacer" and issued Oct. 21, 1997), U.S. Pat. No. 5,705,010 (entitled "Multiple Pane Insulating Glass Unit with Insulative Spacer" and issued Jan. 6, 1998), U.S. Pat. No. 5,714,214 (entitled "Multiple Pane Insulating Glass Unit with Insulative Spacer" and issued Feb. 3, 1998), U.S. Pat. No. 6,301,858 (entitled "Sealant System for an Insulating Glass Unit" and issued Oct. 16, 2001), and U.S. Pat. No. 6,457,294 (entitled "Insulating Glass Unit with Structural Primary Sealant System" and issued Oct. 1, 2002) the entire teachings of each of which are incorporated herein by reference.

The desiccant system 36 is shown generally in FIG. 1, where the desiccant system 36 includes one or more desiccant materials adapted to bind moisture and/or insulative gases within the IG unit 20 and is in communication with the interior 28 of the IG unit 20. In some embodiments, the desiccant system 36 is disposed in the spacer system 34. For example, the spacer system 34 optionally defines an internal cavity, or other chamber or receptacle, adapted to receive the desiccant system 36. In other embodiments, the spacer system 34 is integrated with the desiccant system 36, for example being formed as a foam matrix with the desiccant system 36. In some embodiments the spacer system 34 and/or desiccant system 36 are deposited on the pane(s) 22, 24 or directly in a window sash as a flowable material, such as the warm edge adhesive systems sold under the trade name "KODIMELT TPS," available from ADCO Products, Inc., 4401 Page Avenue, Michigan Center, Mich. 49254, for example.

As designated in FIG. 1, the boundary system 38 includes one or more layers acting, for example, as a structural support, an adhesive, an internal sealant, a moisture barrier, and/or a gas barrier. In some embodiments, the boundary system 38 acts to provide other, additional or alternative features. The boundary system 38 optionally includes a primary sealant 38A and a secondary sealant 38B. The primary sealant 38A is optionally a polyisobutylene-based sealant, additionally or alternatively including foils, adhesive compositions, structural compositions, combinations thereof, and other materials. In turn, in some embodiments, the secondary sealant 38B is a polysulfide-based structural adhesive/sealant, a hot melt butyl adhesive/sealant, a curative hot melt adhesive/sealant, a polysulfide polyurethane adhesive/sealant, a silicone adhesive/sealant. Other, acceptable material combinations for the boundary system 38 are also contemplated.

In some embodiments, the boundary system 38 is disposed toward the edges of the first and second panes 22, 24 to seal the interior 28 and to secure the first and second panes 22, 24 to the spacer system 34. From the foregoing, it should be understood that a variety of configurations for the boundary system 38 are contemplated, including additional or alternate sealant layers.

In general, the interior 28 is an open space between the panes 22, 24 and serves to maintain an internal gas (not shown). The internal gas, which is optionally a gas mixture (e.g., air) or unmixed (e.g., argon) as desired, is initially sealed within the interior 28 at an internal pressure ($P_{INT}$). A variety of types of internal gases are contemplated, including air, noble gases, such as argon and krypton, nitrogen, and others. In general terms, the internal gas acts as an insulator.

Figure 4:
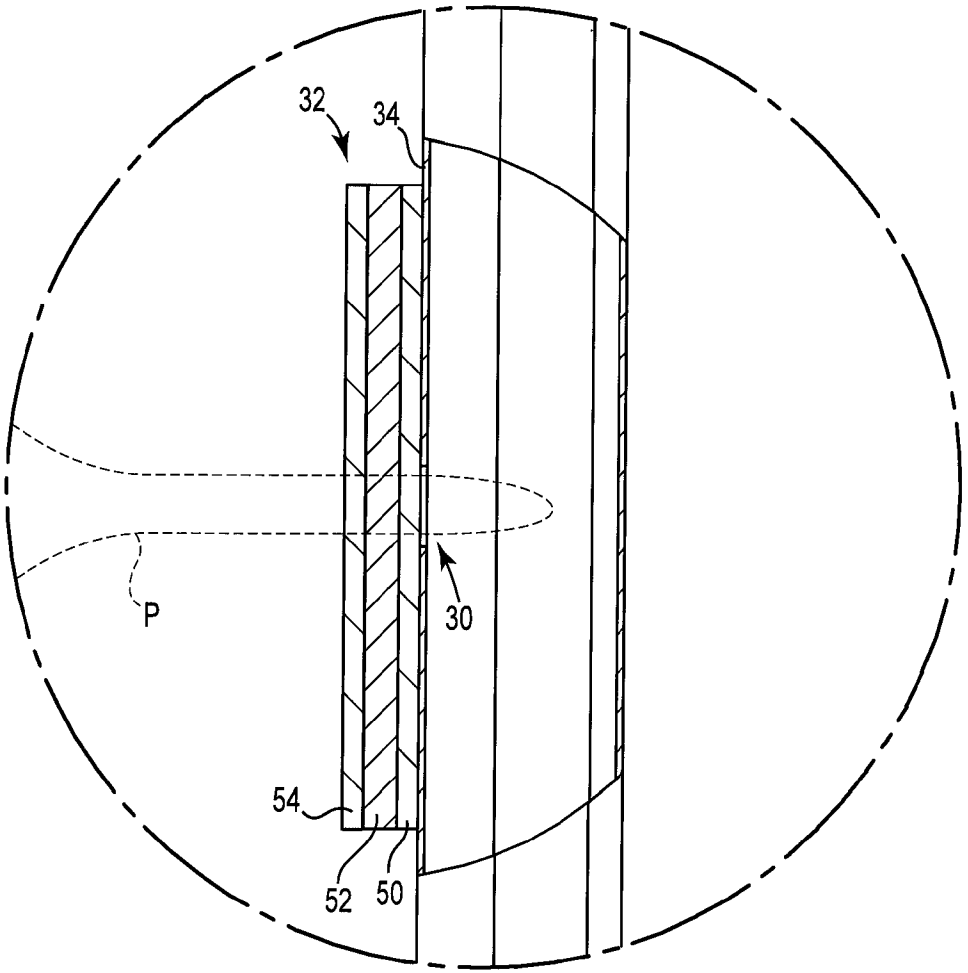
FIG. 4 is an enlarged view from FIG. 3 of the spacer system and self-sealing membrane valve assembly.

The port 30 generally provides access to the interior 28 from a position external to the IG unit 20. FIG. 4 is an enlarged view from FIG. 3 of the spacer system 34 and self-sealing membrane valve assembly 32. As shown in FIGS. 3 and 4, in some embodiments, the port 30 is formed as an aperture (e.g., a drilled or stamped hole) through the spacer system 34 of the perimeter structure 26.

The self-sealing membrane valve assembly 32, also described as a membrane assembly, provides means for self-sealing access to the port 30 and the interior 28. As shown in FIG. 4, the membrane assembly 32 is arranged to block the port 30 by extending over and/or into the port 30, for example. The membrane assembly 32 includes a first sealant layer 50, a second membrane layer 52, and a third sealant layer 54. In some embodiments, the membrane valve assembly 32 includes a fourth protective layer over the third sealant layer 54. The membrane valve assembly 32 is adapted to be self-sealing following puncture. For example, in some embodiments, the self-sealing membrane valve assembly 32 is adapted to be self-sealing following puncture by a gas probe having an effective diameter of about 0.032 inches or less.

The first sealant layer 50 is optionally substantially tacky, being adhesively secured to the perimeter structure 26 (e.g., the spacer system 34). In some embodiments, the first sealant layer 50 is applied concurrently with the second membrane layer 52 to a portion of the perimeter structure 26 (e.g., the spacer system 34) as an assembly. For example, the first sealant layer 50 is optionally coated or otherwise applied to the second membrane layer 52 prior to application of the two layers to the perimeter structure 26 (e.g., prior to application to the spacer system 34).

In some embodiments, the first sealant layer 50 is substantially tacky, serving as an adhesive, and substantially soft. Although softer materials are sometimes quantified using hardness characteristics other than durometer, in some embodiments, the first sealant layer 50 has a first durometer from about 20 A or from about 10 A to about 30 A as tested according to ASTM D2240 ("ASTM Designation: D 2240, Standard Test Method for Rubber Property-Durometer Hardness, 2005"), for example, and a first thickness is from about 0.01 inches to about 0.032 inches, for example, although other characteristics are contemplated as appropriate.

As referenced above, in some embodiments, the first sealant layer 50 is has substantially high creep characteristics and/or is sufficiently tacky to serve as an adhesive layer. In some embodiments, the first sealant layer 50 is adapted to substantially adhere to glass, aluminum, stainless steel, and/or galvanized steel for extended periods. Butyl polyisobutylene is an effective material for the first sealant layer 50 according to some embodiments, although other materials are contemplated.

In some embodiments, the first sealant layer 50 is characterized by substantially low moisture vapor transmission rates, as well as substantially low gas diffusion rates. For example, the first sealant layer 50 is optionally formed of 100% solids PIB material having a specific gravity of about 1.16, a moisture vapor transmission rate of about 0.1 grams/square meter/day as measured using ASTM F1249 (ASTM F1249-06, "Standard Test Method for Water Vapor Transmission Rate Through Plastic Film and Sheeting Using a Modulated Infrared Sensor") at about a 0.080 inch thickness, and an argon diffusion rate of about 0.02 litres/square meter/day as measured at 760 mm HG argon pressure at 3 mm material thickness using ASTM D3985 (ASTM D3985-05, "Standard Test Method for Oxygen Gas Transmission Rate Through Plastic Film and Sheeting Using a Coulometric Sensor"), for example. Some suitable butyl polyisobutylenes, or PIB materials are available from ADCO Products, Inc. of Michigan Center, Mich.

The second membrane layer 52 is substantially thicker and higher durometer than the first sealant layer 50, the second membrane layer 52 being positioned adjacent the first sealant layer 50 in some embodiments. As previously referenced, the second membrane layer 52 is optionally positioned directly on top of the first sealant layer 50, the second membrane layer 52 being secured to the perimeter structure 26 (e.g., the spacer system 34) by the first sealant layer 50. For example, the first sealant layer 50 and the second membrane layer 52 are optionally pre-assembled as a tape construct with the first sealant layer 50 and the second membrane layer 52 combining to provide adhesive, sealant, and self-sealing properties.

In some embodiments, the second membrane layer 52 has a second durometer and a second thickness, each of which are substantially greater than the first durometer and thickness of the first sealant layer 50. A durometer of about 40 A as tested according to ASTM D2240 ("ASTM Designation: D 2240, Standard Test Method for Rubber Property-Durometer Hardness, 2005"), is an appropriate hardness for the second membrane layer 52, according to some embodiments. In some other embodiments, the second durometer is from about 35 A to about 50 A, for example, although other hardness characteristics are contemplated. In some embodiments, the second membrane layer 52 has a thickness from about 0.025 to about 0.045 inches, from about 0.038 inches to about 0.042 inches, or a thickness of about 0.040 inches, for example, although other thicknesses are contemplated. If desired, the second membrane layer 52 is preconditioned with a pre-bake (e.g., at about 200 degrees Fahrenheit for about 2 hours) to reduce outgassing. Chlorobutyl elastomer rubber is an effective material for the second membrane layer 52, although other materials are contemplated.

In some embodiments, the third sealant layer 54 has a third durometer and a third thickness, each of which are substantially less than the second durometer and thickness of the second membrane layer 52. For example, one or both of the third durometer and thickness are optionally substantially the same as the first durometer and thickness. In some embodiments, the third sealant layer 54 has a durometer of about 20 or from about 10 to about 30 as tested according to ASTM D2240 and a thickness from about 0.01 inches to about 0.032 inches, although other hardness values and dimensions are contemplated. If desired, the first and third sealant layers 50, 54 are substantially the same (e.g., substantially the same material, thickness, and softness), although differing first and third sealant layers 50, 54 configurations are contemplated.

FIGS. 1 and 4 are illustrative of methods of assembling the IG unit 20. In particular, in some methods the port 30 in the spacer system 34 is formed prior to applying all of the boundary system 38, for example prior to sealing the interior 28 of the IG unit 20. For example, the first sealant layer 50 and the second membrane layer 52 of the membrane valve assembly 32 are optionally supplied in tape form, are cut to size, and are applied to the spacer system 34 over the port 30 with the first sealant layer 50 adhering the second membrane layer 52 to the spacer system 34.

The desiccant system 36 is applied and the boundary system 38 (e.g., the primary sealant 38A of the boundary system 38) is applied to the spacer system 34 and/or the first and second panes 22, 24. The first and second panes 22, 24 are arranged about the spacer system 34 and the IG unit 20 is sealed by the boundary system 38 (e.g., the primary and secondary sealants 38A, 38B), for example in an argon press, with the interior 28 of the IG unit 20 containing a molar quantity of gas (e.g., argon) at an initial internal pressure ($P_{INT,\ Initial}$) with the first sealant layer 50 and second membrane layers 52 providing sufficient sealing capabilities to retain the gas in the IG unit 20.

In some embodiments the initial internal pressure ($P_{INT}$) corresponds approximately to an ambient pressure at the manufacturing site, where the initial internal pressure ($P_{INT}$) is substantially higher than a desired internal pressure. In other words, the molar quantity of gas is greater than desired. In some embodiments, the quantity of gas in the IG unit 20 is modified such that the IG unit 20 exhibits the desired molar quantity and desired internal pressure ($P_{INT}$) after the IG unit 20 is substantially re-sealed and, in particular, after the self-sealing membrane valve assembly 32 has re-closed to form a gas barrier. For example, in some embodiments, the IG unit 20 is manufactured at a manufacturing site having an atmospheric pressure that is substantially different from the atmospheric pressure at the installation site, where the desired quantity of gas, and thus internal pressure ($P_{INT}$) of the IG unit 20 following manufacture, is pre-selected according to atmospheric pressure at the installation site of the IG unit 20.

In some methods of modifying the internal pressure ($P_{INT}$), a gas probe P (shown generally for illustrative purposes and in broken lines) is inserted through the first sealant layer 50 and the second membrane layer 52 and a desired quantity of gas is removed. The quantity of gas to be removed and the expected internal pressure ($P_{INT}$) are optionally calculated according to the Ideal Gas Law or some modification thereof. After the desired quantity of gas is removed, the third sealant layer 54 is applied over the second membrane layer 52. In some embodiments, the third sealant layer 54 is also supplied in tape form on a removable backer prior to application over the second membrane layer 52. In some embodiments, a final edge coat is applied over the membrane valve assembly 32 and about the perimeter of the IG unit 20. For example, the secondary sealant 38B of the boundary system 38 is optionally applied over the membrane valve assembly 32 about the perimeter of the IG unit 20.

Figure 7:
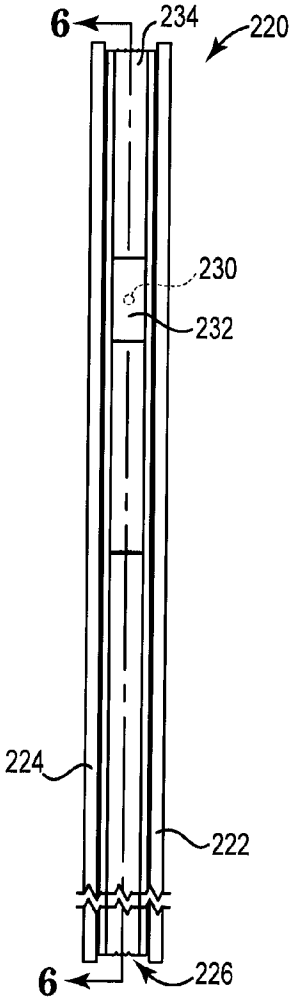
FIG. 7 is an end view of the IG unit of FIG. 5.
Figure 6:
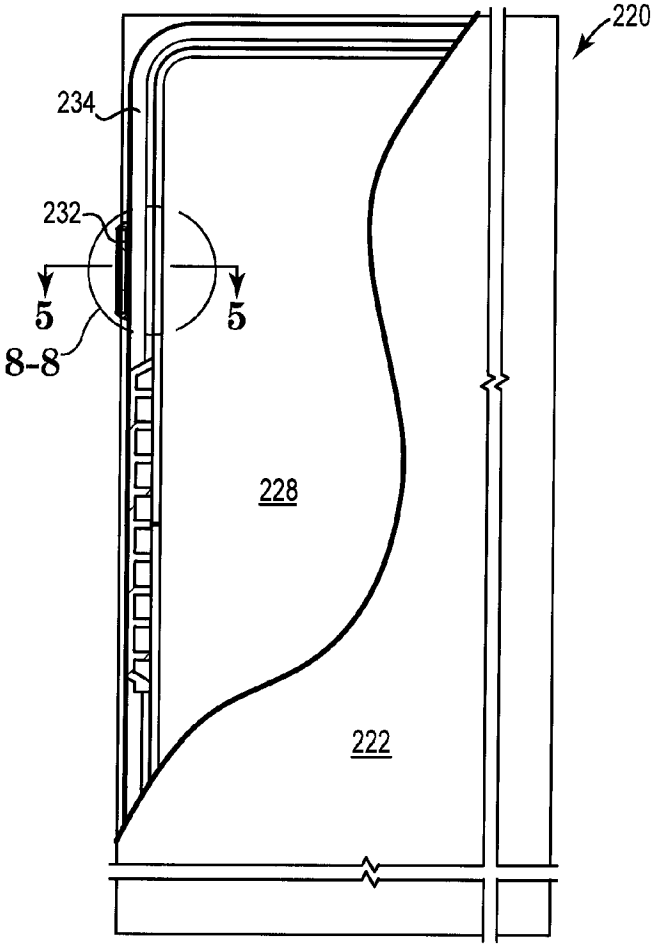
FIG. 6 is a front view of the IG unit of FIG. 5.
Figure 5:
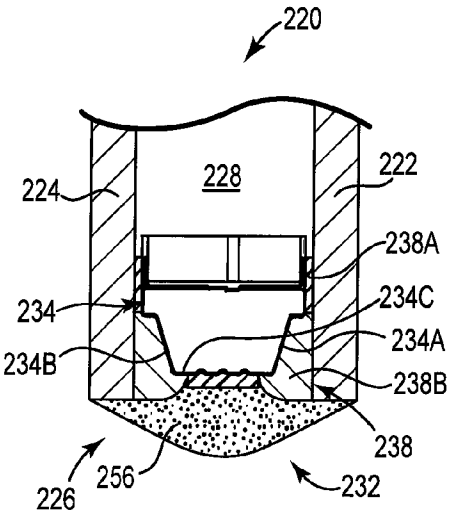
FIG. 5 is a cross-sectional view of another IG unit, according to some embodiments.
Figure 8:
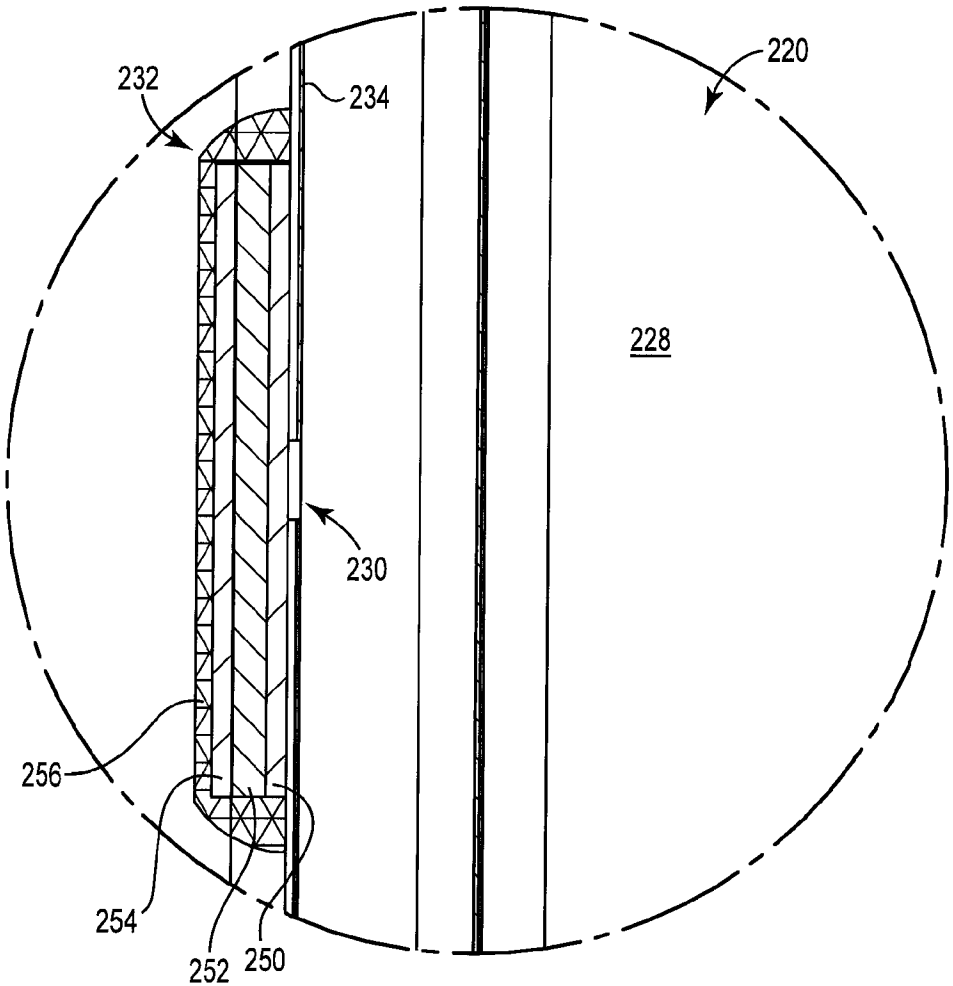
FIG. 8 is an enlarged view from FIG. 6.

Another IG unit 220 is shown in FIGS. 5-8, according to some other embodiments. Various features of the IG unit 220 are substantially similar to those of the IG unit 20, where like features of the IG unit 220 to those of IG unit 20 are designated by the same reference number starting with a "2." With that in mind, the IG unit 220 includes a first pane 222, a second pane 224, and a perimeter structure 226 maintaining the first and second panes 222, 224 in a spaced, sealed relationship to define an interior 228 of the IG unit 220. The IG unit 220 also has a port 230 into the interior 228 of the IG unit 220 and a self-sealing membrane valve assembly 232 blocking the port 230. FIG. 5 shows the IG unit 20 in cross-section (along line 5-5 shown in FIG. 6) through the self-sealing membrane valve assembly 232. FIG. 6 is a front view of the IG unit 220 with a cross-sectional portion removed (along line 6-6 of FIG. 7) to show a central, cross-section of the IG unit 220 near the self-sealing membrane valve assembly 232. FIG. 7 is an end view of the IG unit 20. FIG. 8 is an enlarged view in area 8-8 of FIG. 6 showing the membrane valve assembly 232 in greater detail.

As shown in FIGS. 5-7, the perimeter structure 226 includes a spacer system 234, a desiccant system 236, and a boundary system 238. As seen best in FIG. 5, the spacer system 234 defines a front edge 234A and a rear edge 234B toward the first and second panes 222, 224, respectively, with a central portion 234C between the front and rear edges 234A, 234B. In some embodiments, the secondary sealant 238B of the boundary system 238 is disposed toward the front and rear edges 234A, 234B to help seal the interior 228 and secure the first and second panes 222, 224 to the spacer system 234. For example, the secondary seal 238B of the boundary system 238 optionally includes one or more edge beads of silicone material extending about the perimeter of the IG unit 220. One example of a material for the primary seal 238A is polyisobutylene, for example. In some embodiments, the boundary system covers the front and rear edges 234A, 234B while leaving the central portion 234C of the spacer system 234 substantially exposed.

FIG. 8 is a close up of a portion of the IG unit 220 at a location of the self-sealing membrane valve assembly 232. The membrane assembly 232 includes a first sealant layer 250, a second membrane layer 252, and a third sealant layer 254. As shown, the membrane valve assembly 232 includes a fourth protective layer 256 over the third sealant layer 254. In some embodiments, the fourth protective layer 256 is a silicone cover applied over the third sealant layer 254, where the tacky or adhesive properties of the third sealant layer 254 secure the fourth protective layer 256 to the other portions of the membrane valve assembly 232.

Some methods of assembling the IG unit 220 include forming the port 230 in the spacer system 234 after the IG unit 220 has been sealed with gas in the interior 228 and the boundary system 238 has been applied (as well as the desiccant system 236 where applicable. For example, and as shown in FIG. 5, the port 230 is formed in the central portion 234C of the spacer system 234 and the first sealant layer 250 and the second membrane layer 252 of the membrane valve assembly 232 are optionally supplied in tape form and are applied to the central portion 234C of the spacer system 234 over the port 230.

As with other embodiments, the initial internal pressure ($P_{INT}$) is substantially different than a desired internal pressure. In other words, the molar quantity of gas is different than the desired amount (e.g., more than desired). The quantity of gas in the IG unit 220 is optionally modified by piercing the first sealant layer 250 and the second membrane layer 252 (e.g., with a gas probe) and reducing the molar quantity of gas in the interior 228. The third sealant layer 254 is then applied (e.g., in tape form) and the fourth protective layer 256 is adhesive applied to the IG unit 20 by the third sealant layer 254. In some embodiments, no additional sealant is applied about the perimeter of the IG unit 20 at that time and the fourth protective layer 256 provides structural support and helps ensure a lasting and reliable seal of the IG unit 20.

Figure 9:
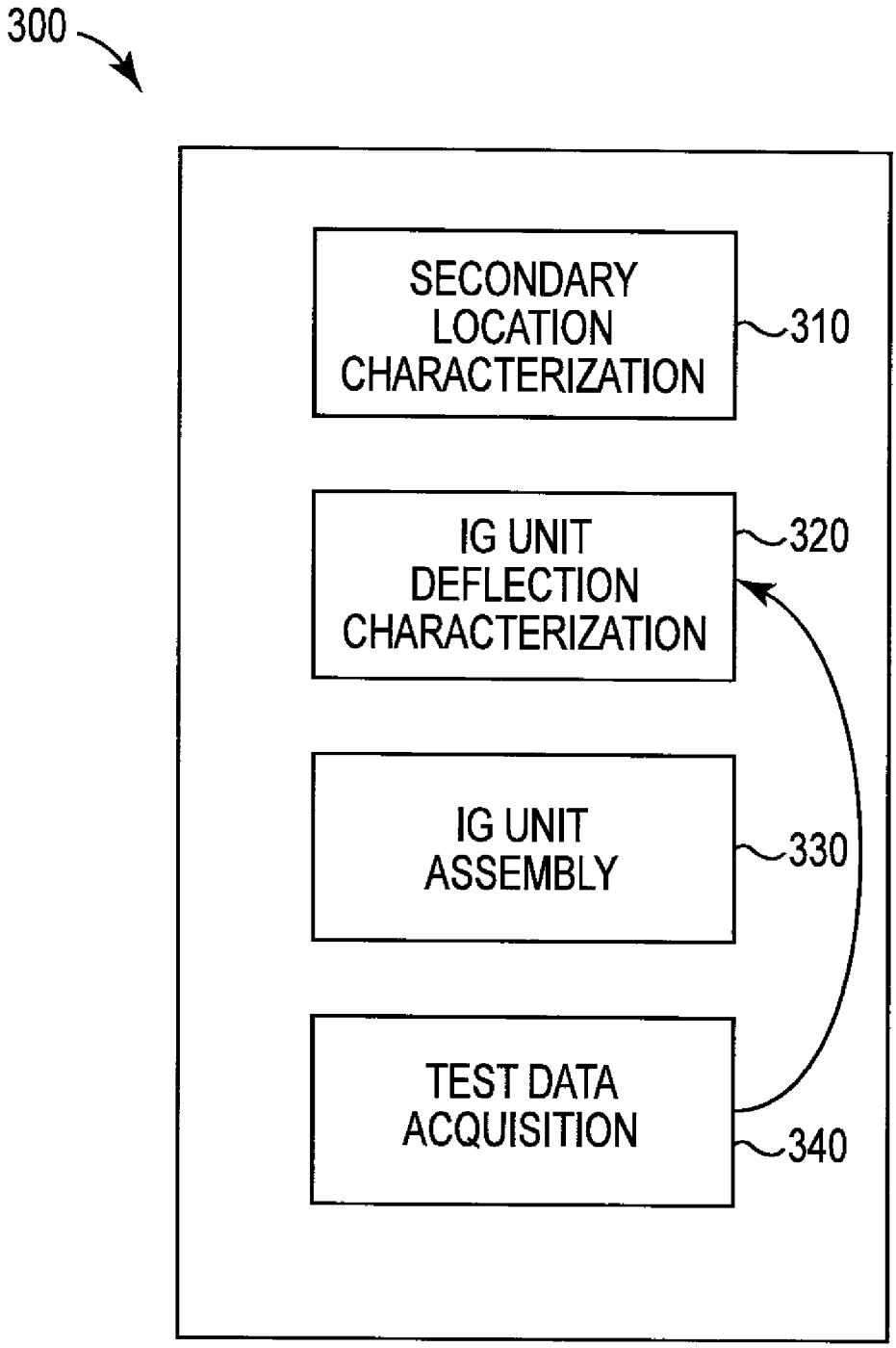
FIG. 9 is a flow chart illustrating a methodology for assembling IG units, according to some embodiments.

In view of the foregoing embodiments, some methods of pre-selecting the internal pressure ($P_{INT}$) of the IG unit 20, for example, similar methodology being optionally applied to the IG unit 220. FIG. 9 relates to a method 300 of manufacturing, or assembling, the IG unit 20 at a manufacturing site with the internal gas sealed in the IG unit 20 being pre-equilibrated for atmospheric conditions at a secondary location, such as an intended installation site for the IG unit 20. In particular, in some embodiments, the internal gas is manufactured to exhibit an internal pressure that substantially corresponds to atmospheric pressure conditions at the installation site of the IG unit 20. For reference, "atmospheric" and "ambient" are generally used to refer to the surrounding conditions of the IG unit 20.

Some methods of providing the IG unit 20 include one or more of a secondary location characterization process 310, an IG unit deflection characterization process 320, an IG unit assembly process 330, and a test data acquisition process 340 as desired.

As a preliminary matter, the secondary location is optionally an installation site for the IG unit 20 (for example a residential building, commercial building, or test site), a storage site for the IG unit 20 (for example a warehouse), an intermediate location of the IG unit 20 during transportation, or other location that has substantially different ambient conditions than the manufacturing site where the IG unit 20 is assembled. In some embodiments, the secondary location resides at a substantially separate geographic location from the manufacturing site; for example, the secondary location is separated by at least about 50 miles, at least about 100 miles, at least about 200 miles, or at least about 500 miles from the manufacturing site according to some embodiments. Furthermore, the secondary location can correspond to a high altitude location (above about 5000 ft), a moderate altitude location (from about 3000 ft to about 5000 ft), or a low altitude location (below about 3000 ft).

For reference, as used herein, atmospheric pressure or temperature characteristics are optionally minimum, maximum, or mean atmospheric pressure or temperature values corresponding to the manufacturing site or the secondary location. Additionally or alternatively, atmospheric pressure or temperature characteristics are optionally expressed as time-dependent relationships (for example, average atmospheric pressure or temperature as a function of day, month, or season). It should also be understood that atmospheric pressure is directly related to altitude. Thus, in some embodiments, atmospheric pressure characteristics are expressed in terms of altitude.

For example, the manufacturing site and the secondary location optionally have different pressure characteristics expressed as a difference in altitude from about 3000 ft to about 5000 ft, from about 5000 ft to about 8500 ft, at least about 4000 ft, at least about 6750 ft, or other range or value. In alternate terms, the manufacturing site and the secondary location have different pressure characteristics expressed directly in terms of pressure differences of from about 0.10 bar to about 0.17 bar, from about 0.17 bar to about 0.27 bar, at least about 0.14 bar, or at least about 0.22 bar, or other range or value.

In some embodiments, the secondary location characterization process 310 is used to evaluate an anticipated external pressure ($P_{EXT}$) and internal pressure ($P_{INT}$), including ranges thereof, for the IG unit 20 at the secondary location. For reference, an external pressure ($P_{EXT}$) acting on the IG unit 20 corresponds to indoor conditions, outdoor conditions, or combinations thereof. The secondary location characterization 310 includes evaluating various atmospheric conditions at the secondary location, and in particular, those that affect the amount of deflection that the first and second panes 22, 24 of the IG unit 20 will exhibit. In other words, an "atmospheric characteristic" is determined and associated with the secondary location according to some embodiments. The atmospheric characteristic is determined based upon altitude, atmospheric or barometric pressures, atmospheric temperatures, weather characteristics, such as anticipated changes in barometric pressure due to storm fronts or seasonal changes, deflection forces from high winds, rain, or hail, or other ambient factors that contribute to IG unit deflection.

The secondary location characterization process 310 is optionally performed using data measured directly from the secondary location or data taken for broader region including the secondary location, for example. The process 310 is also optionally performed using data taken from preexisting databases, such as trend charts, historical values, or other sources having atmospheric information for the secondary location. In some embodiments, the deflection characteristic for the secondary location includes a range or band of altitudes, temperatures, or other ambient conditions generally characterizing the secondary location. For example, the deflection characteristic optionally includes information relating to the secondary location being within an altitude band of about 1,000 ft to about 1,200 ft above sea level.

"Atmospheric" or "ambient" conditions are not limited to the conditions "outside." In other words, the atmospheric characteristic optionally includes "interior" conditions associated with a building into which the IG unit 20 is installed. For example, if the IG unit 20 is to be installed in a building that has a high internal temperature or pressure, the atmospheric characteristic of the secondary location optionally reflects ambient conditions within the building as well. As one non-limiting example, the atmospheric characteristic of the secondary location in one embodiment includes minimum, average, and maximum internal (i.e., within the building into which the IG unit 20 will be installed) and external (outside of the building into which the IG unit 20 will be installed) temperatures and pressure values.

In terms of the IG unit deflection characterization process 320, the IG unit 20 has a variety of properties that are usable to establish a "deflection characteristic" of the IG unit 20 that is related to an amount of deflection that the IG unit 20 tends to exhibit. The deflection characteristic is optionally determined empirically, for example by measuring actual deflection of the IG unit 20 at various external pressure ($P_{EXT}$), internal pressure ($P_{INT}$), and internal temperature ($T_{INT}$) values.

The deflection characteristic is also optionally determined theoretically, for example via computer modeling, or as a combination of empirical and theoretical methods. Thus, the deflection characteristic is determined via estimation, mathematical derivation, iterative experimentation, direct measurement, or other means. In some embodiments, reference materials, such as "ASTM Designation: E 1300-04e1, Standard Practice for Determining Load Resistance of Glass in Buildings, 2004," the contents of which are generally incorporated herein by reference, are utilized in determining a deflection characteristic for the IG unit 20. For example, the ASTM Designation: E 1300-04e1 describes methods of evaluating load resistance for IG units, which is directly related to deflection of IG unit glass in terms of probabilities of breakage for IG units having various properties.

In some embodiments, the IG unit deflection characterization process 320 includes determining IG unit properties such as a total open internal volume ($V_{INT}$) of the IG unit 20, the spacing between the first and second panes 22, 24, the material of the first and second panes 22, 24, including material properties of the first and second panes 22, 24, the thickness of each of the first and second panes 22, 24, the shape of the IG unit 20, including the aspect ratio of the first and second panes 22, 24, the type of gas used in the IG unit 20, and other IG unit properties. A relationship between an acceptable amount of deflection of the first and second panes 22, 24 and one or more of external pressure ($P_{EXT}$), internal pressure ($P_{INT}$), and internal temperature ($T_{INT}$) values is then established using various properties of the IG unit 20, such as those previously described.

The effect of the internal pressure ($P_{INT}$) in the IG unit 20 can be understood with reference to the Ideal Gas Law, $P_{INT}V_{INT}=nRT_{INT}$, where ($V_{INT}$) is gas volume (corresponding to the open volume of the interior 28), (n) is a molar quantity of the gas, (R) is a gas constant for the internal gas, and ($T_{INT}$) is the temperature of the internal gas. In particular, the quantity of gas (n) drives internal pressure $P_{INT}$ as a function of internal temperature ($T_{INT}$). The internal pressure $P_{INT}$ as a function of internal temperature $T_{INT}$ for a particular molar quantity of internal gas is also referred to herein as the internal pressure characteristic of the IG unit 20.

In terms of obtaining a desired internal pressure characteristic, the IG unit 20 is transitioned from an initial internal pressure characteristic corresponding to the initial quantity of internal gas to a desired internal pressure characteristic corresponding to the modified quantity (i.e., reduced or increased quantity) of internal gas. The target or desired internal pressure characteristic is selected according to conditions at the secondary location, for example in order to reduce expected deflection of the IG unit at the secondary location.

The following is a simplified example for illustration purposes only, where the average ambient temperature at the secondary location is 25 degrees C., the average atmospheric pressure at the secondary location is 0.8 bar, and the internal gas is sealed in the IG unit 20 at 25 degrees and 1.0 bar at the manufacturing site. In order to minimize deflection stresses on the IG unit 20 at the secondary location, it would be desirable to reduce the quantity of free gas in the interior 28 of the IG unit 20 such that the IG unit 20 exhibits 0.8 bar internal pressure ($P_{INT}$) at 25 degrees C.

As part of the IG unit assembly process 330 and as described above, the internal pressure ($P_{INT}$) is optionally reduced by reducing the molar quantity (n) of free gas in the IG unit 20 such that the IG unit 20 exhibits a desired internal pressure characteristic at the secondary location. However, in order to gain a more accurate determination of the desired internal pressure characteristic, considerations such as anticipated temperature and pressure ranges at the secondary location, the deflection characteristic of the IG unit 20, safety factors, and others, including those previously described, are built into the IG unit assembly process 330.

As previously referenced, the internal gas is generally sealed in the interior 28 at ambient pressure and/or temperature conditions associated with the manufacturing site. In this situation, it should be understood that the IG unit 20 will often tend to exhibit a vacuum pressure ($P_{INT}$) relative to the ambient conditions at the manufacturing site (i.e., the unit 20 will exhibit a lower internal pressure ($P_{INT}$) than the external pressure ($P_{EXT}$) at the manufacturing site). Where the resulting internal pressure ($P_{INT}$) of the IG unit 20 is relatively low, the IG unit 20 is generally well-suited to a high-altitude secondary location, as the barometric pressure in the high-altitude location will generally be lower. In other words, the IG unit 20 is pre-equilibrated to the high-altitude location by reducing internal pressure ($P_{INT}$), such that a pressure differential between the internal pressure ($P_{INT}$) of the IG unit and the external pressure ($P_{EXT}$) at the secondary location will be reduced. This, in turn, reduces an expected amount of deflection of the first and second panes 22, 24. As previously described, other factors, such as anticipated internal temperature ($T_{INT}$) of the IG unit 20 at the secondary location for example, can also play a role in selecting a desired internal pressure characteristic of the IG unit 20.

It should also be understood that the IG unit 20 can be equilibrated to a location having a relatively higher atmospheric pressure than atmospheric conditions at the manufacturing site. For example, although not a typical application, the internal gas is optionally injected at a relatively higher pressure than ambient at the secondary location such that the IG unit 20 tends to exhibit a desired internal pressure ($P_{INT}$) corresponding to the secondary location (where the internal pressure ($P_{INT}$) of the IG unit 20 is actually higher than the external pressure ($P_{EXT}$) at the manufacturing site).

In some embodiments, the IG unit assembly process 330 is carried out at one manufacturing site while in others the manufacturing process occurs at multiple manufacturing sites. Regardless, in some embodiments, the internal pressure ($P_{INT}$) of the IG unit 20 is modified according to the desired internal pressure characteristic for the secondary location (e.g., the installation site for the IG unit 20).

The test data acquisition process 340 is optionally performed after the IG unit 20 is disposed at the secondary location, for example following installation of the IG unit 20 at an installation site such as a residential or commercial building. Alternatively or additionally, the test data acquisition process 340 is optionally performed on one or more IG units that have not been pre-equilibrated to the secondary location. In general terms, the test data acquisition process 340 includes evaluating the installation site and expected or actual IG unit performance at the installation site. Additionally or alternatively, a proxy site to the installation site (e.g., a location having similar ambient conditions or a test apparatus) is used to gather test data according to the test data acquisition process 340.

Various modifications and additions can be made to the exemplary embodiments discussed without departing from the scope of the present invention. For example, although methods of pre-equillibrating or pre-calibrating the IG unit 20 internal pressure ($P_{INT}$) to a secondary location have been provided, in some other embodiments the membrane valve assembly 32 is accessed at the secondary location (e.g., an installation site) in order to modify the internal pressure ($P_{INT}$) of the IG unit 20. For example, an installer optionally uses a mobile gas unit (not shown) to puncture and add or remove gas from the IG unit 20 at an installation site (e.g., upon perceiving unwanted deflection in the IG unit 20). An additional sealant/protective layer would optionally be applied to the IG unit 20 at the installation site in order to help ensure lasting and reliable sealing of the interior 28 of the IG unit 20 such that the IG unit 20 maintained the desired internal pressure characteristic.

Additionally, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A membrane valve assembly for an insulated glass (IG) unit having a port into an interior space of the IG unit, the membrane valve assembly being adapted to be substantially self-sealing following puncture to access the port, the membrane valve assembly comprising:

a first sealant layer of butyl polyisobutylene having a first thickness and a first durometer;

a second membrane layer of chlorobutyl elastomer rubber over the first sealant layer, the second membrane layer having a second thickness substantially greater than the first thickness and a second durometer from about 35 A to about 50 A, the second membrane layer being substantially harder than the first sealant layer; and a third sealant layer over the second membrane layer that is substantially softer than the second membrane layer.

2. The membrane valve assembly of claim 1, wherein the third sealant layer is a butyl polyisobutylene sealant.

3. The membrane valve assembly of claim 1, wherein the second membrane layer has a thickness of from about 0.01 inches to about 0.032 inches.

4. A method of manufacturing an insulated glass (IG) unit for installation at an installation site, the insulated glass (IG) unit including a perimeter structure having a port a first pane supported by the perimeter structure; a second pane supported by the perimeter structure opposite the first pane with an interior space defined between the first and second panes that is sealed and connected to the port; a membrane valve assembly adapted to act as a self-sealing access to the port, the membrane valve assembly being arranged to block the port and including a first sealant layer that is substantially tacky, the first sealant layer being secured to the perimeter structure; a second membrane layer over the first sealant layer and secured to the perimeter structure by the first sealant layer, the second membrane layer having a second durometer of from about 35 A to about 50 A; and a third sealant layer over the second membrane layer, the third sealant layer being substantially softer than the second membrane layer, the method comprising:

forming the port into the perimeter structure;

blocking the port with the self sealing membrane arranging the first pane opposite a second pane and sealing a space between the first and second panes to define the interior space of the IG unit;

puncturing the self sealing membrane with a gas probe and modifying an amount of gas in the IG unit; and removing the probe and allowing the self sealing membrane to close such that the interior of the IG unit is substantially re-sealed.

5. The method of claim 4, wherein gas is initially sealed in the interior of the IG unit at a manufacturing site at an initial pressure that is higher than a desired internal pressure and further wherein modifying the amount of gas in the IG unit includes puncturing the self sealing membrane with the gas probe and removing gas from the interior such that the IG unit exhibits the desired internal pressure after the IG unit is substantially re-sealed.

6. The method of claim 5, wherein the IG unit is manufactured at a manufacturing site having an atmospheric pressure that is substantially different from an atmospheric pressure at the installation site and further wherein the desired internal pressure is pre-selected according to the atmospheric pressure at the installation site of the IG unit.

7. The method of claim 6, wherein the difference between the atmospheric pressure at the installation site and the manufacturing site is about 0.15 bar or greater.

8. The method of claim 4, further comprises preconditioning the second membrane layer with a pre-bake.

9. The method of claim 4, further comprising disposing a secondary sealant about the perimeter of the IG unit.

10. The method of claim 4, wherein the space between the first and second panes is sealed to define the interior space of the IG unit after the port is formed in the spacer system.

11. An insulated glass (IG) unit comprising:

a perimeter structure having a port;

a first pane supported by the perimeter structure;

a second pane supported by the perimeter structure opposite the first pane with an interior space defined between the first and second panes that is sealed and connected to the port;

a membrane valve assembly adapted to act as a self-sealing access to the port, the membrane valve assembly being arranged to block the port and including:

a first sealant layer that is substantially tacky, the first sealant layer being secured to the perimeter structure;

a second membrane layer over the first sealant layer and secured to the perimeter structure by the first sealant layer, the second membrane layer having a second durometer of from about 35 A to about 50 A; and a third sealant layer over the second membrane layer, the third sealant layer being substantially softer than the second membrane layer.

12. The IG unit of claim 11, wherein the second membrane layer is a chlorobutyl elastomer rubber.

13. The IG unit of claim 11, wherein the first and third sealant layers are butyl polyisobutylene sealants.

14. The IG unit of claim 13, further comprising a fourth protective layer of a silicone over the third sealant layer.

15. The IG unit of claim 11, wherein the first and third membrane layers each have a durometer from about 10 A to about 30 A.

16. The IG unit of claim 11, wherein the second membrane layer has a thickness from about 0.025 to about 0.045 inches.

17. The IG unit of claim 11, wherein the second membrane layer has a thickness from about 0.038 inches to about 0.042 inches.

18. The IG unit of claim 11, wherein the third sealant layer has a thickness of from about 0.01 inches to about 0.032 inches.

19. The IG unit of claim 11, wherein the first sealant layer and the second membrane layer are preformed as a tape material that is subsequently applied to the perimeter structure.

20. The IG unit of claim 11, wherein the second membrane layer is adapted to be self-sealing following puncture by a gas probe having an effective diameter of about 0.032 inches.

21. A membrane valve assembly for an insulated glass (IG) unit having a port into an interior space of the IG unit, the membrane valve assembly being adapted to be substantially self-sealing following puncture to access the port, the membrane valve assembly comprising:

a first sealant layer of butyl polyisobutylene having a first thickness and a first durometer;

a second membrane layer of chlorobutyl elastomer rubber over the first sealant layer, the second membrane layer having a second thickness substantially greater than the first thickness and a second durometer from about 35 A to about 50 A, the second membrane layer being substantially harder than the first sealant layer; and a third sealant layer over the second membrane layer and having a third thickness that is substantially less than the second thickness and being substantially softer than the second membrane layer.

* * * * *

UNITED STATES PATENT AND TRADEMARK OFFICE

CERTIFICATE OF CORRECTION

PATENT NO. : 8,316,596 B2
APPLICATION NO. : 12/559913
DATED : November 27, 2012
INVENTOR(S) : Anderson et al.

It is certified that error appears in the above-identified patent and that said Letters Patent is hereby corrected as shown below:

In the Claims

Column 12, Line 13, Claim 4

After "port" add -- ; --

Column 12, Line 30, Claim 4

After "membrane" add -- ; --

Signed and Sealed this
Twenty-fifth Day of August, 2015

Michelle K. Lee

Michelle K. Lee
*Director of the United States Patent and Trademark Office*